US011906175B2

(12) United States Patent
Harrington et al.

(10) Patent No.: US 11,906,175 B2
(45) **Date of Patent: *Feb. 20, 2024**

(54) ORIENTATION-BASED HVAC CONTROL

(71) Applicant: Trane International Inc., Davidson, NC (US)

(72) Inventors: Neal Harrington, Tyler, TX (US); Thomas Gort, Tyler, TX (US); James R. M. Neal, Tyler, TX (US)

(73) Assignee: Trane International Inc., Davidson, NC (US)

( * ) Notice: Subject to any disclaimer, the term of this patent is extended or adjusted under 35 U.S.C. 154(b) by 0 days.

This patent is subject to a terminal disclaimer.

(21) Appl. No.: 18/069,762

(22) Filed: Dec. 21, 2022

(65) Prior Publication Data

US 2023/0129818 A1 Apr. 27, 2023

Related U.S. Application Data

(63) Continuation of application No. 17/138,621, filed on Dec. 30, 2020, now Pat. No. 11,585,543.

(51) Int. Cl.

| | |
|---|---|
| ***F24D 19/10*** | (2006.01) |
| ***F24F 11/89*** | (2018.01) |
| *F24F 140/00* | (2018.01) |
| *F24F 110/10* | (2018.01) |

(52) U.S. Cl.

CPC ..... *F24D 19/1084* (2013.01); *F24F 11/89* (2018.01); *F24F 2110/10* (2018.01); *F24F 2140/00* (2018.01); *F24F 2221/34* (2013.01)

(58) Field of Classification Search

CPC ... F25D 19/1084; F24F 11/89; F24F 2140/00; F24F 2110/10; F24F 2221/34

See application file for complete search history.

(56) References Cited

U.S. PATENT DOCUMENTS

| | | | | |
|---|---|---|---|---|
| 9,437,097 | B2 | 9/2016 | Poursohi et al. | |
| 11,585,543 | B2 * | 2/2023 | Harrington | F24D 19/1084 |
| 2008/0011109 | A1 | 1/2008 | Bourgein | |
| 2011/0160914 | A1 * | 6/2011 | Kennett | G05B 15/02 700/276 |

(Continued)

FOREIGN PATENT DOCUMENTS

| | | |
|---|---|---|
| JP | 2015-232418 | 12/2015 |
| WO | 2020096477 A1 | 5/2020 |

*Primary Examiner* — Marc E Norman

(74) *Attorney, Agent, or Firm* — WOMBLE BOND DICKINSON (US) LLP

(57) ABSTRACT

Example embodiments of the present disclosure relate to a control system for controlling an HVAC device where the control system includes a temperature sensor that provides a signal indicative of a temperature associated with the HVAC device, an orientation sensor that provides a signal indicative of an operating orientation of the HVAC device, and control circuitry that receives the temperature signal and the orientation signal from the orientation sensor. The control circuitry selects an operating thermal control set point from a plurality of stored thermal control set points based at least in part on an orientation signal, determines a temperature sensor input based on the temperature signal and compares the temperature sensor input to the operating thermal control set point, and operates the HVAC device based at least in part on that comparison.

20 Claims, 13 Drawing Sheets

(56) References Cited

U.S. PATENT DOCUMENTS

| | | | |
|---|---|---|---|
| 2015/0015694 | A1 | 1/2015 | Au et al. |
| 2016/0238246 | A1 | 8/2016 | Albright et al. |
| 2021/0302056 | A1 | 9/2021 | Eskew et al. |
| 2023/0062041 | A1* | 3/2023 | Eskew ..... F24F 11/36 |

* cited by examiner

ORIENTATION-BASED HVAC CONTROL

CROSS-REFERENCE TO RELATED APPLICATION

This present application is a continuation of U.S. patent application Ser. No. 17/138,621, which was filed on Dec. 30, 2020, and entitled "ORIENTATION-BASED HVAC CONTROL," and which is hereby incorporated by reference in its entirety.

TECHNOLOGICAL FIELD

The present disclosure relates generally to a system and method for controlling a device, potentially an HVAC device such as a furnace, an air handler with an electric heating element, etc., using an orientation sensor to determine and adjust operating parameters.

BACKGROUND

Many HVAC devices have various temperature limits or temperature ranges associated with the device and/or one or more components of the device. These temperature limits are particularly prevalent in heating devices such as furnaces, many of which have temperature limits established for safety reasons. For example, various regulations require furnaces and other HVAC heating devices to supply conditioned air at or below a maximum temperature.

Existing methods for monitoring the conditioned supply air temperature rely on bi-metallic switches located within the HVAC device. While these switches may be cost effective and may provide an indication of the supply air temperature, they suffer from several deficiencies. For example, these types of switches only provide a binary indication of whether the temperature at one location is over or under a given temperature limit, and even then only for a narrow temperature range. The heat flow in a device may also differ based on the orientation of the device, and existing switches are unable to account for a device's orientation. For example, the switch may be in a relatively hot location in one orientation of the device, and the same location may be a relatively cool location in a second orientation of the device. As a result, existing bi-metallic switches may provide a different supply conditioned air temperature across a range of operating orientations of the device.

Current systems require extensive testing to identify appropriate bi-metallic temperature switches and/or switch locations that can meet the various requirements (e.g., certification, regulatory compliance, etc.) applied to these systems in all orientations. This often leads to multiple, iterative tests to determine the appropriate switch settings and switch location that will allow a given switch within the furnace to operate appropriately in all orientations. Even after this testing, that selection often only applies to a given switch location, orientation, or device. If changes occur when the device is installed in an operating position or a device is positioned differently than anticipated, the wrong temperature switch may be used or the switch may not be located properly for a given application. This issue is exacerbated when errors occur after installation, because the service technicians often differ from the manufacturing/installation personnel. These technicians may not have all possible temperature switches or sufficient knowledge regarding performance of the unit. This may lead to the wrong switch being used, sub-standard device performance (e.g. premature switch trips), and/or devices that exceed temperature limits.

BRIEF SUMMARY

Thus, there exists a need for an improved system and method for monitoring the temperature of a device or device component, while accounting for the orientation of the device. This system may utilize improved temperature sensors as well as an orientation sensor that allows for enhanced understanding of the temperature flowing through the device or device component. This may provide a faster and more efficient, design, manufacture, and commissioning process as well as improved performance. In addition, by improving the internal diagnostics of a device, the inventive system and method disclosed herein, may also allow the device to include additional performance functionality.

The present disclosure thus includes, without limitation, the following example implementations.

Some example implementations provide a control system for an HVAC device comprising: a temperature sensor configured to provide a signal indicative of a temperature associated with the HVAC device; an orientation sensor configured to provide a signal indicative of an operating orientation of the HVAC device; and control circuitry that receives the signal from the temperature sensor and the signal from the orientation sensor, wherein the control circuitry selects an operating thermal control set point from a plurality of stored thermal control set points based on the signal from the orientation sensor; wherein the control circuitry determines a temperature sensor input based on the signal from the temperature sensor and compares the temperature sensor input to the operating thermal control set point, and wherein the control circuitry operates the HVAC device based at least in part on the comparison between the temperature sensor input and the operating thermal control set point.

In some example implementations of the control system of any example implementation, or any combination of any preceding example implementation, the orientation sensor is one of a gyroscope or an accelerometer.

In some example implementations of the control system of any example implementation, or any combination of any preceding example implementation, the temperature sensor is one of a thermistor or a thermocouple.

In some example implementations of the control system of any example implementation, or any combination of any preceding example implementation, the HVAC device further comprises a cabinet partition, a conditioned air inlet, and a conditioned air outlet, wherein the control circuitry determines an orientation sensor input based on the signal from the orientation sensor, and wherein the orientation sensor input provides an orientation of the conditioned air outlet from the HVAC device.

In some example implementations of the control system of any example implementation, or any combination of any preceding example implementation, the HVAC device is a furnace, and the temperature sensor is located on the furnace cabinet partition.

In some example implementations of the control system of any example implementation, or any combination of any preceding example implementation, the temperature associated with the HVAC device is the temperature of a conditioned supply air at the conditioned air outlet.

In some example implementations of the control system of any example implementation, or any combination of any preceding example implementation, further comprising a supply air duct connected to the conditioned air outlet, wherein the temperature sensor is coupled to the supply air duct.

In some example implementations of the control system of any example implementation, or any combination of any preceding example implementation, the temperature sensor comprises two or more temperature sensors, wherein one of the temperature sensors is located proximate the conditioned air inlet and one of the temperature sensors is located proximate the conditioned air outlet; and the temperature associated with the HVAC device is based on the signals from the two or more temperature sensors.

In some example implementations of the control system of any example implementation, or any combination of any preceding example implementation, the temperature associated with the HVAC device is a differential temperature measurement, wherein the differential temperature measurement is a temperature rise of a conditioned air fluid flowing through the HVAC device based on the temperature of the conditioned air fluid proximate the conditioned air inlet and the temperature of the conditioned air fluid proximate the conditioned air outlet.

In some example implementations of the control system of any example implementation, or any combination of any preceding example implementation, the control circuitry is configured to shut off the operation of the HVAC device when the temperature sensor input exceeds the operating thermal control set point.

In some example implementations of the control system of any example implementation, or any combination of any preceding example implementation, wherein the HVAC device is a gas-fired furnace, and the control circuitry is configured to close a gas valve to shut off the gas-fired furnace.

In some example implementations of the control system of any example implementation, or any combination of any preceding example implementation, the HVAC device is an air handler with an electric heater, and the control circuitry is configured to stop an electric current flow to the electric heater.

Some example implementations provide a method of controlling an HVAC heating device comprising: determining an operating orientation of the HVAC heating device using an orientation sensor; determining an operating thermal control set point associated with the HVAC heating device using control circuitry, wherein the operating thermal control set point is dependent at least in part on the operating orientation of the HVAC heating device; monitoring a temperature associated with the HVAC heating device during operation using a temperature sensor; determining a temperature sensor input related to the temperature associated with the HVAC heating device using control circuitry; and operating the HVAC heating device based at least in part on a comparison between the temperature sensor input and the determined operating thermal control set point.

In some example implementations of the method of any example implementation, or any combination of any preceding example implementation, the HVAC heating device comprises a conditioned air inlet and a conditioned air outlet, and wherein the determining the operating orientation of the furnace includes determining the location of the conditioned air outlet from the HVAC device.

In some example implementations of the method of any example implementation, or any combination of any preceding example implementation, operating the HVAC heating device comprises terminating heat production when the temperature sensor input exceeds the operating thermal control set point.

In some example implementations of the method of any example implementation, or any combination of any preceding example implementation, the HVAC heating device is a gas-fired furnace, and terminating heat production comprises closing a gas valve.

In some example implementations of the method of any example implementation, or any combination of any preceding example implementation, the HVAC heating device is an air handler with an electric heater, and terminating heat production comprises stopping an electric current flow to the electric heater.

In some example implementations of the method of any example implementation, or any combination of any preceding example implementation, operating the HVAC heating device comprises adjusting an output heat capacity below a heating demand call when the temperature sensor input approaches the operating thermal control set point.

In some example implementations of the method of any example implementation, or any combination of any preceding example implementation, determining the operating thermal control set point comprises selecting the operating thermal control set point from a set of predetermined thermal control set points corresponding to an expected set of operating orientations of the heating device.

In some example implementations of the method of any example implementation, or any combination of any preceding example implementation, the selected operating thermal control set point corresponds to a maximum permissible supply conditioned air temperature for the heating device.

These and other features, aspects, and advantages of the disclosure will be apparent from a reading of the following detailed description together with the accompanying drawings, which are briefly described below. The disclosure includes any combination of two, three, four, or more of the above-noted embodiments as well as combinations of any two, three, four, or more features or elements set forth in this disclosure, regardless of whether such features or elements are expressly combined in a specific embodiment description herein. This disclosure is intended to be read holistically such that any separable features or elements of the disclosed disclosure, in any of its various aspects and embodiments, should be viewed as intended to be combinable unless the context clearly dictates otherwise.

BRIEF DESCRIPTION OF THE FIGURE(S)

In order to assist the understanding of aspects of the disclosure, reference will now be made to the appended drawings, which are not necessarily drawn to scale. The drawings are provided by way of example to assist in the understanding of aspects of the disclosure, and should not be construed as limiting the disclosure.

DETAILED DESCRIPTION

Figure 1:
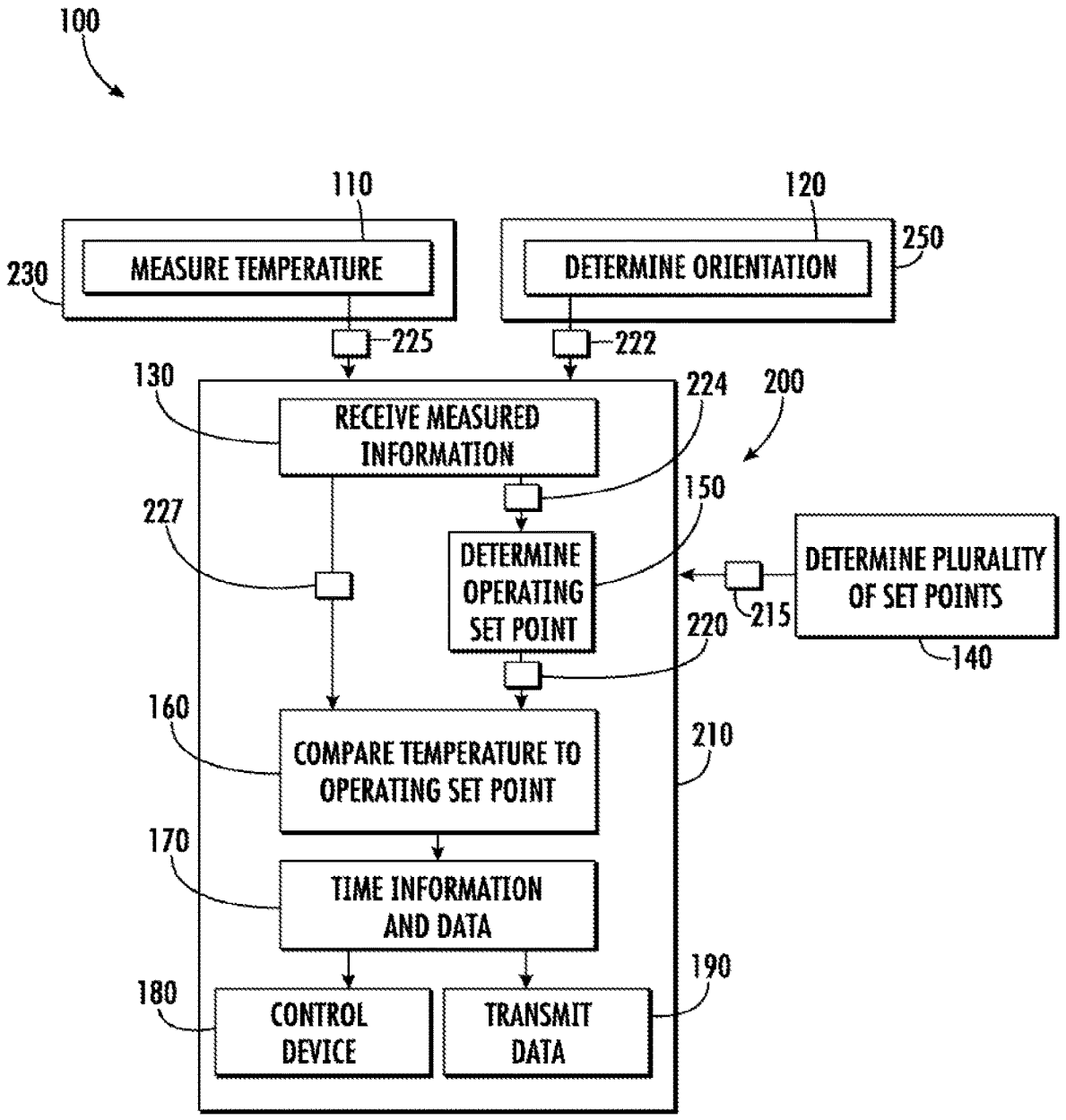
FIG. 1 is a block diagram of an orientation-based temperature monitoring system, according to an example embodiment of the present disclosure.

Some implementations of the present disclosure will now be described more fully hereinafter with reference to the accompanying figures, in which some, but not all implementations of the disclosure are shown. Indeed, various implementations of the disclosure may be embodied in many different forms and should not be construed as limited to the implementations set forth herein; rather, these example implementations are provided so that this disclosure will be thorough and complete, and will fully convey the scope of the disclosure to those skilled in the art.

For example, unless specified otherwise or clear from context, references to first, second or the like should not be construed to imply a particular order. A feature described as being above another feature (unless specified otherwise or clear from context) may instead be below, and vice versa; and similarly, features described as being to the left of another feature may instead be to the right, and vice versa. Also, while reference may be made herein to quantitative measures, values, geometric relationships or the like, unless otherwise stated, any one or more if not all of these may be absolute or approximate to account for acceptable variations that may occur, such as those due to engineering tolerances or the like.

As used herein, unless specified otherwise or clear from context, the "or" of a set of operands is the "inclusive or" and thereby true if and only if one or more of the operands is true, as opposed to the "exclusive or" which is false when all of the operands are true. Thus, for example, "[A] or [B]" is true if [A] is true, or if [B] is true, or if both [A] and [B] are true. Further, the articles "a" and "an" mean "one or more," unless specified otherwise or clear from context to be directed to a singular form. Like reference numerals refer to like elements throughout.

As used herein, the terms "bottom," "top," "upper," "lower," "upward," "downward," "rightward," "leftward," "interior," "exterior," and/or similar terms are used for ease of explanation and refer generally to the position of certain components or portions of the components of embodiments of the described disclosure in the installed configuration (e.g., in an operational configuration, such as located at a residence or building). It is understood that such terms are not used in any absolute sense.

Example implementations of the present disclosure relate generally to an improved system and method for controlling a heat generating HVAC device, and in particular, utilizing sensing components and controls for modulating the operation of the device to improve the safety and/or performance. Example implementations will be primarily described in conjunction with furnaces used in HVAC applications, but it should be understood that example implementations may be utilized in conjunction with a variety of other applications. For example, other HVAC devices include, but are not limited to, indoor units, outdoor units, heaters (electric or otherwise), heat pumps, boilers as well as other devices generally including water heaters, kitchen appliances, and the like may utilize the system and method described herein. Furthermore, it should be understood that unless otherwise specified, the terms "data," "content," "digital content," "information," and similar terms may be at times used interchangeably.

Example embodiments of the present disclosure combine inputs from both a temperature sensor and an orientation sensor to determine existing operating parameters of a device. Based on the combination of data, the system is able to determine whether the operation of the device should be adjusted. In some embodiments, the system compares these inputs with stored values indicative of how the device should operate. Based on this comparison, the system determines whether the operation of the device should be adjusted and provides instructions for the adjustment. In some embodiments, the system adjustment includes shutting off the device. In some embodiments, the system adjustment includes adjusting the device's performance or operation, at times, such that the device operates at a performance below the performance called for by other operating parameters of the system.

FIG. 1 shows a block diagram illustrating various components of an example implementation of the present disclosure. Each of these steps will be discussed in more detail below, however, first an overview of the system is described. In one embodiment, at step 110, the system 100 uses a temperature sensor 230 to measure the temperature of the device or a component of the device and provide a signal 225 indicative of the measured temperature. At step 120, the system 100 uses an orientation sensor 250 to measure an operating orientation associated with the device and provide a signal 222 indicative of the operating orientation of the HVAC device. The control circuitry 210 of the system 100 receives this information at step 130. In some embodiments, the control circuitry 210 may also determine a temperature sensor input 227 based on the temperature signal 225 provided by the temperature sensor 230, and the control circuitry 210 may also determine an orientation sensor input 224 based on the orientation signal 222 provided by the orientation sensor 250. The control circuitry 210 also receives a plurality of thermal control set points 215 determined at step 140. In some embodiments, the plurality of thermal control set points 215 may have been predetermined during a calibration process of the device or through other processes. The plurality of thermal control set points 215 may also correspond in whole or in part to one or more operating orientations of the device. At step 150, the system 100 determines the operating thermal control set point 220 from the plurality of thermal control set points 215 to use for controlling the operation of the device. This selection of the operating thermal control set point 220 may be based in whole or in part on the information received from the orientation sensor 250 at step 120. The system 100 then compares information from a temperature sensor input 227 which is based on the temperature signal 225 with the operating thermal control set point 220 at step 160. This comparison may determine whether the temperature of a given device or component of a device is over or under the operating thermal control set point 220. In some embodiments, the system 100 may determine the magnitude of difference between the temperature sensor input 227 and the operating thermal control set point 220. In some embodiments, the system 100 may include a step 170 where the system tracks the temperature sensor input 227 over time and/or tracks the comparison between the temperature sensor input 227 and the operating thermal control set point 220 over time. Based on the measurements received and the comparisons made, the system 100 may control one or more operating parameters of a device at step 180. In some embodiments, the system 100 may also transmit data received and/or determined during the one or more steps previously described at an additional step 190.

Walking through these steps in more detail, the measure temperature step 110 may be performed by one or more temperature sensors 230. Temperature sensors 230 may be any device configured to measure temperature and provide the system 100 with a signal 225 indicative of the temperature measured. The temperature signal 225 may be transmitted to the control circuitry 210 and provide information regarding the temperature measured by the temperature sensor 230. The temperature signal 225 may be any communication signal used to transmit this information. In some embodiments, the temperature signal 225 is an electrical signal comprising a voltage and/or amperage indicative of the temperature measured by the temperature sensor 230. The system 100 may utilize other types of temperature signals 225 (e.g., optical signals, wireless communication protocols, etc.). In some embodiments, the temperature signal 225 may be transmitted through multiple devices and multiple forms (e.g., a wireless temperature sensor transmitting a temperature signal to a remote server, etc.). As discussed below in connection with step 130, in some embodiments, the system 100 includes a temperature sensor input 227, where the temperature sensor input 227 is based on whole or in part on the temperature signal 225. The temperature sensor input 227 is also indicative of the temperature measured by the temperature sensor, and the system 100 uses the temperature signal 225 to determine the temperature sensor input 227.

Temperature sensors 230 may be any type of temperature sensor that provides the functionality required to perform the system and method described herein. For example, some temperature sensors may be thermistors, thermocouples, or other types of temperature sensors. The disclosure further contemplates a system or method utilizing a plurality of temperature sensors of a single type or a combination of two or more different types of temperature sensors.

The measure temperature step 110 may be directed to measuring the temperature of one or more of a device, a component of the device, fluid passing through a device, or potentially other aspects of the device. In some embodiments, the temperature sensor is located on an object or area of the device that is of interest. In these embodiments, the temperature sensor may measure the temperature directly on the object or area being measured. In other embodiments, the temperature sensor is not located directly on the object or area of interest. In these embodiments, the temperature sensor may measure the temperature of the object or area of interest indirectly. In some embodiments, this may be performed by measuring the temperature of related objects or areas and/or by measuring the temperature of objects or areas near the object or area of interest. In all of these configurations, the temperature measured by the temperature sensor(s) may need to be calibrated or adjusted to reflect a more accurate indication of the temperature of the object or area of interest.

Some embodiments may comprise two or more temperature sensors. In some of these embodiments, each temperature sensor 230 may provide an independent temperature signal 225 where each temperature signal 225 provides an indication of the temperature measured by each temperature sensor 230. In other embodiments, the temperature sensors 230 may provide a temperature signal 225 that provides a combined indication of the temperature measured by the temperature sensors. This combined indication may come in various different forms. For example, the combined indication may be a differential temperature measurement where the combined indication is the difference between the temperature measured from two temperature sensors, which may be positioned before and after a heat exchanger respectively. This differential temperature may provide a temperature rise associated with a given device component or fluid flow. In other examples, the combined indication may be an average (weighted or unweighted) of the measured temperature from two or more temperature sensors 230. Other methods for combining the information provided by these temperature sensors 230 are contemplated by this disclosure.

The determine orientation step 120 may be performed by an orientation sensor 250. The orientation sensor 250 may be any device configured to measure orientation and provide the system 100 with an orientation signal 222 indicative of the operating orientation of the device 200. For example, orientation sensor 250 may be a gyroscope, an accelerometer, or other device. In some embodiments the orientation sensor may provide a signal providing an indication of whether a device is installed in an upward configuration, a downward configuration, a horizontal configuration or potentially more detailed horizontal information such as whether the device is oriented to the left or right relative to a space (e.g., a reference location or feature such as the floor or ground) and/or other component (e.g., a combustion compartment of a furnace). In one embodiment, the determine orientation step 120 comprises providing an orientation signal 222 that provides an indication of the operating orientation of a device 200. In another embodiment, the orientation signal 222 provides an indication of the orientation of a component of the device 200 or a component associated with the device 200. Some embodiments further comprise more than one orientation sensor. These embodiments may combine the orientation measured from the orientation sensors to obtain more detailed or more accurate orientation information.

At step 130, the signals obtained at the measure temperature step 110 and determine orientation step 120 may be transmitted and/or received by control circuitry 210. This transmission and receiving process may occur in a variety of different ways. For example, the temperature sensor 230 and/or the orientation sensor 250 may be electrically connected to the control circuitry 210. The disclosure also contemplates other transmission and receiving processes, including wireless protocols, optical transmission, and others.

At step 130, the system 100 may also determine a temperature sensor input 227 and/or an orientation sensor input 224. In some embodiments, the system 100, potentially using the control circuitry 210, determines the temperature sensor input 227 based on the temperature signal 225. In some embodiments, the temperature sensor input 227 may be based in whole or in part on temperature signal 225 received from the temperature sensor(s) 230. In some embodiments, the temperature sensor input 227 may be the temperature signal 225. In some embodiments, the temperature signal 225 may be converted into a temperature sensor input 227 in another form that may be used by the system to perform other steps or functions. In some embodiments, the temperature sensor input 227 is representative of the temperature measured by the temperature sensor. In some embodiments, the temperature sensor input 227 is representative of the differential temperature measured by two or more temperature sensors. In some embodiments, the temperature sensor input 227 is representative of an average temperature (weighted or unweighted) measured by the two or more temperature sensors. In some embodiments, the temperature sensor input 227 is representative of temperature measured by one of a plurality of temperature sensors. The disclosure herein contemplates other forms of the temperature sensor input that may be used with the system and method disclosed herein.

In some embodiments, the system 100, potentially using the control circuitry 210, determines an orientation sensor input 224 based on the orientation signal 222. This process may be similar to process described above with regards to the temperature sensor input 227. For example, in some embodiments, the orientation sensor input 224 may be based in whole or in part on the orientation signal 222 received from the orientation sensor(s) 250. In some embodiments, the orientation sensor input 224 may be the orientation signal 222. In some embodiments, the orientation signal 222 may be converted into an orientation sensor input 224 in another form that may be used by the system to perform other steps or functions. In some embodiments, the orientation sensor input 224 is representative of the operating orientation of the device as measured by the orientation sensor. In some embodiments, the orientation sensor input 224 is representative of the operating orientation of a component of the device as measured by the orientation sensor. The disclosure herein contemplates other forms of the orientation sensor input that may be used with the system and method disclosed herein.

According to example embodiments of the present disclosure, the control circuitry 210 may be implemented by various means. Means for implementing the control circuitry may include hardware, alone or under direction of one or more computer programs from a computer-readable storage medium. In some examples, the control circuitry is formed of one or more circuit boards. The control circuitry may be centrally located or distributed throughout an HVAC or other device system. For example, the control circuitry may be formed of distinct circuit boards including a circuit board positioned in the thermostat, and one or more circuit boards positioned at or within the HVAC or other device equipment (e.g., at a furnace configured to circulate or otherwise provide conditioned air to the conditioned space).

Figure 2:
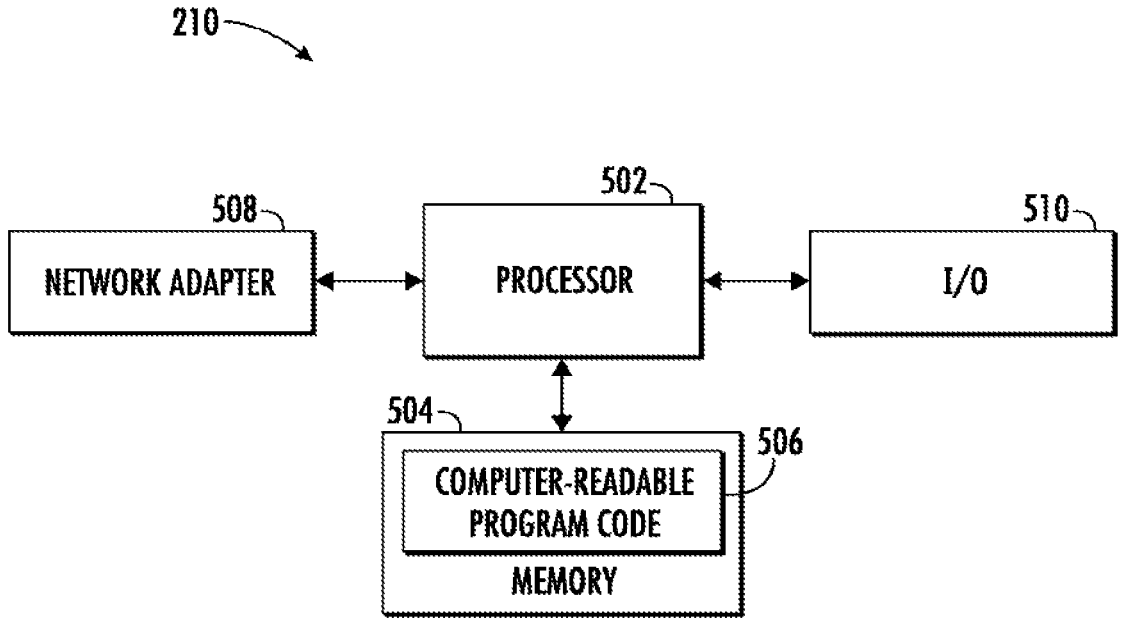
FIG. 2 illustrates control circuitry, according to an example embodiment of the present disclosure.

FIG. 2 illustrates the control circuitry 210 according to some example embodiments of the present disclosure. The control circuitry may include one or more of each of a number of components such as, for example, a processor 502 connected to a memory 504. The processor is generally any piece of computer hardware capable of processing information such as, for example, data, computer programs and/or other suitable electronic information. The processor includes one or more electronic circuits some of which may be packaged as an integrated circuit or multiple interconnected integrated circuits (an integrated circuit at times more commonly referred to as a "chip"). The processor 502 may be a number of processors, a multi-core processor or some other type of processor, depending on the particular implementation.

The processor 502 may be configured to execute computer programs such as computer-readable program code 506, which may be stored onboard the processor or otherwise stored in the memory 504. In some examples, the processor may be embodied as or otherwise include one or more ASICs, FPGAs or the like. Thus, although the processor may be capable of executing a computer program to perform one or more functions, the processor of various examples may be capable of performing one or more functions without the aid of a computer program.

The memory 504 is generally any piece of computer hardware capable of storing information such as, for example, data, computer-readable program code 506 or other computer programs, and/or other suitable information either on a temporary basis and/or a permanent basis. The memory may include volatile memory such as random access memory (RAM), and/or non-volatile memory such as a hard drive, flash memory or the like. In various instances, the memory may be referred to as a computer-readable storage medium, which is a non-transitory device capable of storing information. In some examples, then, the computer-readable storage medium is non-transitory and has computer-readable program code stored therein that, in response to execution by the processor 502, causes the control circuitry 210 to perform various operations as described herein, some of which may in turn cause the HVAC system to perform various operations.

In addition to the memory 504, the processor 502 may also be connected to one or more peripherals such as a network adapter 508, one or more input/output (I/O) devices 510 or the like. The network adapter is a hardware component configured to connect the control circuitry 210 to a computer network to enable the control circuitry to transmit and/or receive information via the computer network. The I/O devices may include one or more input devices capable of receiving data or instructions for the control circuitry, and/or one or more output devices capable of providing an output from the control circuitry. Examples of suitable input devices include a keyboard, keypad or the like, and examples of suitable output devices include a display device such as a one or more light-emitting diodes (LEDs), a LED display, a liquid crystal display (LCD), or the like.

Referring back to FIG. 1, the step of determining the plurality of thermal control set points 140 can be accomplished in a variety of ways. In one embodiment, this step is accomplished by calibrating the system 100 and the device 200 through testing. In some embodiments, this calibration testing includes calibrating the device based on the expected operating orientations of the device. In some embodiments, calibration testing may occur before the device is operated for its intended use, and the plurality of thermal control set points are predetermined.

In some embodiments, calibration testing is directed to determining temperature limits or temperature ranges for the operation of a given device or component of the device. These temperature limits or ranges may originate from a variety of different sources, including regulations, guidelines, industry standards, engineering principles, performance specifications, or other sources.

In some embodiments, calibration testing is performed to calibrate the temperature sensor to accurately correlate the temperature measured by the temperature sensor to the temperature of an object or area of interest. This calibration may be directed to one or more temperature limits or temperature ranges associated with the object or area of interest. In one embodiment, the calibration testing comprises locating one or more temperature sensors at various different locations on the device or near the device. This process also includes measuring the temperature of an area or object of interest during calibration with a separate temperature probe while also reading the temperature measured from the temperature sensor 250. The calibration testing determines whether any offset or adjustment needs to be made to the temperature measured by a temperature sensor(s) at a given location(s) to accurately reflect the temperature of the area or object of interest. This calibration testing may be repeated with the temperature sensor(s) located at multiple different locations. It may also be repeated with the device configured at different orientations.

In some embodiments, the plurality of thermal control set points are determined through calibration testing at multiple different temperature sensor locations and/or device orientations. At each location and orientation combination, the temperature measured by the temperature sensor(s) 250 is determined when the device is operating and the object or area of interest is at a given temperature limit or temperature range as determined by the testing temperature probe. At any given device orientation, the temperature sensor(s) may be calibrated at multiple different locations. Each calibration performed determines the appropriate offset or adjustment for a given temperature sensor location in that orientation. The determined thermal control set point may be the temperature measured by the temperature sensor at that location and device orientation when the area or object of interest is at the temperature limit or temperature range.

In addition, the plurality of thermal control set points are not limited to only specific temperatures per se. Other correlation techniques are contemplated within the scope of this disclosure. In general, the plurality of thermal control set points relates to values used to correlate the temperature measured by a temperature sensor(s) at a given location and device orientation to the temperature of an object or area of interest at a given temperature limit or temperature range. For example, in some embodiments, at each location and orientation combination, a set temperature limit or temperature range may correspond to all of the plurality of thermal control set points, and in these embodiments, the actual thermal control set points may be the offsets or adjustments. In these embodiments, the control circuitry 210 may select the appropriate offset or adjustment to appropriately correlate the temperature measured by the temperature senor to the set temperature limit or temperature range based at least in part on the orientation signal. The offset or adjustment may be applied to either the temperature measured by the temperature sensor or the set temperature limit or temperature range to allow for this correlation. In other embodiments, the plurality of thermal control set points may be a temperature differential associated with a location and orientation combination. In these embodiments, the thermal control set points may correspond to a desired temperature rise associated with the device or device component. Here the thermal control set points are the measured temperature differential observed by two or more temperature sensors each at a given location. The thermal control set points in these embodiments correspond to a desired temperature rise at a given device orientation.

In addition, the disclosure contemplates other methods for determining the plurality of thermal control set points at step 140. The thermal control set points may be determined through a calibration process on a similar or standard device, or even a different device where the determined thermal control set points can be correlated to the device of interest. In addition, the thermal control set points may also be determined through modeling, simulation, and other calculation-based methods. Thermal control set points may also come directly from sources including regulations, guidelines, industry standards, engineering principles, performance specifications, or other sources. Further, if a given temperature limit or temperature range is adjusted over time or for other reasons, the plurality of thermal control set points may be updated to correspond to this revised temperature limit or temperature range.

The plurality of thermal control set points may be transmitted and/or received by the control circuitry 210. This transmission and receiving process may occur in a variety different ways. For example, the plurality of thermal control set points may be transmitted via an electrical connection to the control circuitry. The disclosure also contemplates other transmission and receiving processes, including wireless and optical protocols, manual input, and others. Once these set points have been received by the control circuitry they may be stored in device memory, potentially in the control circuitry memory.

At step 150, the control circuitry 210 determines the operating thermal control set point 215 based on the orientation signal 222 and/or the orientation sensor input 224. The plurality of thermal control set points 215 may correspond to an installed orientation of the device or orientation of a component of the device. Some embodiments where the control circuitry 210 uses the orientation sensor input 224 are initially discussed. In some embodiments, this determination at step 150 may be based only on the orientation sensor input 224 received by the control circuitry 210. In some of these embodiments, each of the plurality of thermal control set points 215 corresponds to a given orientation sensor input 224. In these embodiments, the control circuitry 210 determines the operating thermal control set point 220 as the thermal control set point that corresponds to the orientation sensor input 224. In other embodiments, this determination may be based on the orientation sensor input 224 and other information received from the control circuitry 210. For example, each of the plurality of thermal control set points 215 may correspond to a given orientation sensor input 224 and other factors (e.g., time, system operation, temperature sensor location, device capacity, etc.). In these embodiments, the control circuitry 210 determines the operating thermal control set point 220 based on the orientation sensor input 224 and other factors. In addition, in some embodiments, the orientation sensor input 224 used at this step 150 is received while the device 200 is operating. In other embodiments, the orientation sensor input 224 used at step 150 is received when the device is installed or at other points in time, and the orientation sensor input 224 is stored in memory for when the device is operational. In some embodiments, the system 100 may store the operating thermal control set point 220 in memory for use with the present disclosure. Embodiments that utilize the orientation signal 222 at step 150 instead of the orientation sensor input 224 operate similarly to the embodiments discussed above. In these embodiments, the plurality of thermal control set points correspond to the orientation signal 222.

At the compare temperature to operating set point step 160, the control circuitry 210 utilizes the operating thermal control set point 220 from step 150 and compares that to the temperature sensor input 227 obtained from the temperature sensor 230 via the temperature signal 225. This comparison may come in various different forms. For example, in some embodiments, the control circuitry 210 determines whether the temperature sensor input 227 is over, under, or equal to the operating thermal control set point. In embodiments where the thermal control set points 227 are a temperature range, the control circuitry 210 may determine whether the temperature sensor input is within the temperature range or outside the temperature range. In some embodiments, the control circuitry 210 may determine the magnitude of the difference between the temperature sensor input 227 and the operating thermal control set point 220.

In some embodiments, where the plurality of thermal control set points 215 corresponds to a temperature offset or adjustment associated with the installed orientation of the device, this comparison step may be more involved. In these embodiments, as described above, the system may include a set temperature limit or temperature range associated with all of the plurality thermal control set points 215. Because in these embodiments the operating thermal control set point corresponds to an offset or an adjustment, at this comparison step, step 160, the operating thermal control set point 220 may be used to offset or adjust either the temperature sensor input 227 or the set temperature limit or temperature range. Then in these embodiments the control circuitry compares the temperature sensor input to the temperature limit or temperature range.

In some embodiments, at an additional step 170, the system 100 may also track this information over time. This may include timing the comparison between the temperature sensor input 227 and the operating thermal control set point 220 at the compare temperature to operating set point step 160. In some embodiments, this step 170 involves measuring the time after the temperature sensor input 227 exceeds the operating thermal control set point 220. In other embodiments, step 170 involves measuring how many times the temperature sensor input 227 exceeds the operating thermal control set point 220 over a given time period, or the percentage of time the temperature sensor input 227 exceeds the operating thermal control set point 220 over a period of time. In other embodiments, step 170 involves tracking the difference between the temperature sensor input 227 and the operating thermal control set point 220 continuously over time. In some embodiments, the system 100 may track the temperature sensor input 227 over time and determine whether the temperature sensor input 227 is approaching the operating thermal control set point 220. Other correlations between the collected or derived data and time are also contemplated within the scope of this disclosure.

At the control device step 180, the system 100 controls the device 200 based in whole or in part on the comparison step 160 where the temperature sensor input 227 and the operating thermal control set point 220 are compared. In some embodiments, at step 180 the device 200 is shut off when the temperature sensor input 227 exceeds the operating thermal control set point 220. In some embodiments, this shut off occurs immediately. In other embodiments, the shut off occurs after an additional event has occurred. For example, in some embodiments the shut off occurs after the temperature sensor input 227 exceeds the operating thermal control set point 220 for a period of time. In another embodiment, the shut off occurs after the temperature sensor input 227 exceeds the operating thermal control set point 220 a certain number of times, or a certain number of times over a period of time, or for a certain percentage of a given time period. In other embodiments, the shut off occurs when the temperature sensor input 227 approaches the operating thermal set point 220.

In other embodiments, at step 180, the operation of the device 200 is adjusted based on the comparison step 160. The operation of the device 200 may be increased or decreased in a given fashion. In some embodiments, the device lowers the capacity of the device output to less than the output capacity requested from the device. In an HVAC device, this may include lowering the heating or cooling capacity of the device to below the heating or cooling demand requested by the HVAC system and/or thermostat. For example, a thermostat in a given comfort space may request a certain level of heating capacity (e.g., a volume of air flow in CFM at a given temperature) via a heating demand call to an HVAC device. In some embodiments, when the temperature sensor input 227 exceeds the operating thermal control set point 220, the system 100 may adjust the operation of the HVAC device to provide a heating capacity that is less than the required capacity to meet heating load requested by the thermostat. Various other configuration and control scheme are contemplated within the scope of this disclosure.

Some embodiments also include a transmit data step 190. At this step, the system 100 may transmit data collected or derived by the system. In some embodiments, the system 100 transmits an alert when the temperature sensor input 227 exceeds the operating thermal control set point 220. In some embodiments, the system 100 transmits an alert when the temperature sensor input 227 approaches or is trending towards the operating thermal control set point 220. In some embodiments, the system transmits an indication that a component or feature in the device 200 has failed or may be nearing failure. In some embodiments, the system 100 transmits the data associated with the temperature sensor 230 and/or orientation sensor 250. In some embodiments, the system 100 transmits the temperature sensor input 227 and/or the orientation sensor input 224. In some embodiments, the system 100 transmits the temperature sensor input 227 and/or the orientation sensor input 224 associated with time and/or the comparison with the operating thermal control set point 220. Other combinations or types of data may be transmitted at this step as well.

In one embodiment, the system 100 is utilized on an HVAC device. The HVAC device may be any type of device, including a furnace, an indoor unit, outdoor unit, an air handler with a heating element, and/or a heat pump. Other types of HVAC devices are contemplated within the scope of this disclosure. To further illustrate the inventive system and method, an embodiment where the system is utilized with a furnace is described more fully below.

In one embodiment where the system is utilized on a furnace, the measure temperature step may comprise measuring the temperature of the conditioned supply air leaving the furnace. In this embodiment, the temperature sensor may be located on a furnace partition wall and/or one or more other locations. By measuring the temperature at a location on the furnace partition, the temperature sensor provides a signal indicative of the temperature of the conditioned supply air exiting the furnace. The temperature sensor may also be located on other components within the furnace to provide a signal indicative of the conditioned supply air temperature. The temperature sensor may also be located outside the furnace, for example, on the supply air duct of the furnace to provide a signal indicative of the conditioned supply air temperature.

In this embodiment, the determine orientation step may include using an orientation sensor to provide a signal indicative of an operating orientation of the furnace. In this embodiment, an orientation sensor may be located on the furnace, for example, on an integrated furnace control board. The orientation sensor may provide an orientation signal indicative of the operating orientation of the furnace and/or the orientation of the conditioned air discharge of the furnace. This orientation signal may indicate that the furnace is located upward, downward, or horizontal. The orientation sensor may further provide an indication of whether the furnace is horizontal to the left or horizontal to the right, or it may potentially provide more specific orientation information. For clarification, in some embodiments, a furnace with an orientation of horizontal left may correspond to a furnace oriented in the horizontal position relative to the floor of a space, wherein the furnace discharges supply air to the left of the combustion section when facing the front of the furnace, again relative to the floor. Similarly, in some embodiments, a furnace with an orientation of horizontal right may correspond to a furnace oriented in the horizontal position relative to the floor of the space, wherein the furnace discharges supply air to the right of the combustion section, again relative to the floor. FIGS. 10A-13C show illustrations of these embodiments, with FIGS. 10A, 10B, and 11A-C showing embodiments with a horizontal right configuration, and FIGS. 12A, 12B, and 13A-C showing embodiments with a horizontal left configuration. In other embodiments, the measured orientation may also provide an indication of whether the conditioned air outlet is at an upflow configuration, a downflow configuration, or a horizontal flow configuration, potentially horizontal to the left or right.

In one embodiment, the furnace is subjected to a calibration testing process to determine the plurality of thermal control set points. In some embodiments, this calibration testing corresponds to the expected operating orientations of the furnace. In some embodiments, a temperature limit exists for the conditioned supply air leaving the furnace (e.g., a limit of no greater than 160° F.). In some embodiments, this temperature limit may be the maximum allowable conditioned supply air temperature permissible by the device. This temperature limit may be determined by regulator standards (e.g., ANSI) or other methods. In this embodiment, calibration testing may start at a given orientation, for example upflow. In this orientation, a temperature sensor is located on a furnace partition at a first location. The furnace is operated and when the supply conditioned air temperature reaches 160° F., as determined according to regulatory standards, for example, the measured temperature from the temperature sensor 250 is recorded. This measured temperature may be less than 160° F., because the temperature sensor is located a distance away from the conditioned supply air temperature. In some embodiments, the measured temperature may be greater than 160° F., because the temperature sensor may be located proximate to heat generating element(s). This process may be repeated at this orientation and temperature sensor location to determine the appropriate thermal control set point for the furnace at that orientation and temperature sensor location. Once the thermal control set point is determined for that orientation and temperature sensor location, the temperature sensor is then moved to a second location. In one embodiment, the furnace orientation, upward, remains the same. In this embodiment, the furnace is operated to determine the temperature measured by the temperature sensor at the second location when the conditioned supply air temperature reaches 160° F. This allows the system to determine another thermal control set point, one corresponding to the second temperature sensor location. Once the appropriate number of thermal control set points for the upward orientation are determined, the furnace may be configured in a different orientation, for example a downward orientation. The temperature sensor is located at a given location for this configuration, which may be the same or different from the sensor location for another orientation. The furnace is operated to determine the temperature measured by the temperature sensor at this orientation when the conditioned supply air temperature reaches 160° F. This allows the system to determine another temperature set point, one corresponding to the downward orientation and the set temperature sensor location. This process is repeated until the thermal control set point is determined for all the relevant orientation and temperature sensor location combinations. Each of these thermal control set points corresponds, at least in part, to the orientation of the device.

In one embodiment, the plurality of thermal control set points may already be saved in memory when the furnace is installed. The plurality of saved thermal control set points may have been predetermined by the calibration process discussed above or a different method. In one embodiment, a temperature sensor may be located on a partition within the furnace when the furnace is installed. In another embodiment, the temperature sensor may be located on the supply air duct. In one embodiment, the orientation sensor may be located on an integrated furnace control board within the furnace.

In one embodiment, during operation, the temperature sensor may measure the temperature at a given location and send a temperature signal indicative of the measured temperature. The orientation sensor may also measure the orientation of the furnace and send a signal indicative of of the operating orientation of the furnace. The temperature signal and the orientation signal may be sent to the control circuitry. The control circuitry may determine a temperature sensor input based on the temperature signal and the temperature sensor input may also be indicative of the temperature measured by the temperature senor. The control circuitry may also determine an orientation sensor input based on the orientation signal, and the orientation sensor input may also be indicative of the operating orientation of the furnace. The control circuitry uses the measured sensor input to choose the operating thermal control set point that corresponds to an operating orientation of the furnace.

In one embodiment, the control circuitry compares the temperature sensor input to the operating thermal control set point. If the temperature sensor input is lower than the operating thermal control set point the system may take no action. In this embodiment, if the temperature sensor input exceeds the operating thermal control set point the system may shut the furnace off. In some embodiments, if the temperature sensor input exceeds the operating thermal control set point for a set period of time the system shuts the furnace off In some embodiments, if the temperature sensor input approaches the operating thermal control set point the system shuts the furnace off.

The system may shut off the furnace or HVAC device in a variety of ways. In some embodiments, this shut off comprises terminating the heat production of the device. In one embodiment, where the furnace is a gas-fired furnace, the system may shut off the burners. This may be accomplished by closing the gas-supply valve. In other embodiments, such as embodiments associated with air handler units utilizing electric heaters, this may be accomplished by stopping or limiting the electric current flow to the electric heating element (e.g., stopping the electric current flow to an electric heat strip to shut off the electric heater). The system may also stop the flow of other heating sources such as closing the hot water supply valve for a device utilizing hot water coils or shutting off the compressor to stop the flow of refrigerant in a heat pump. Other methods of shutting off the system are contemplated within the scope of this disclosure.

In some embodiments, if the temperature sensor input exceeds the operating thermal control set point the system adjusts the performance of the device in some manner. In some of such embodiments, the system may adjust the output capacity of the furnace to below the output capacity requested by other components of the HVAC system, e.g., a thermostat. For example, in some embodiments, a thermostat may send a demand call (e.g., a heating demand call, etc.) to a furnace to satisfy a given heating load. In some embodiments, the present system may adjust the operation of the furnace when the temperature sensor input exceeds the operating thermal control set point, and in some embodiments, this adjustment may be performed by adjusting the burner or heating element (e.g., electric heater, etc.) output of the furnace to supply an output heating capacity below the heating demand call. The adjustment may also be performed by adjusting the blower airflow or both. In some embodiments, the blower airflow is increased to lower the supply conditioned air temperature. In some embodiments, the operational adjustments are continued until the temperature sensor input is lower than the operating thermal control set point. In embodiments, where the device is able to perform cooling operations, the thermostat may send a demand call for cooling, and the system may adjust the device in a similar manner for cooling operations as described above with regards to heating operations.

In some embodiments, the system further includes a transmitter. In some such embodiments, the system may provide an alert or indication when the temperature sensor input exceeds the operating thermal control set point. In one embodiment, the system provides an alert or indication when the temperature sensor input approaches the operating thermal control set point. In another embodiment, the system provides an alert or indication when the furnace is shut off because the temperature sensor input exceeds the operating thermal control set point. In another embodiment, the system provides an alarm or indication when the system adjusts the output capacity of the furnace to below the output capacity requested. Other alarms, indications, or data may be transmitted as well.

Figure 3:
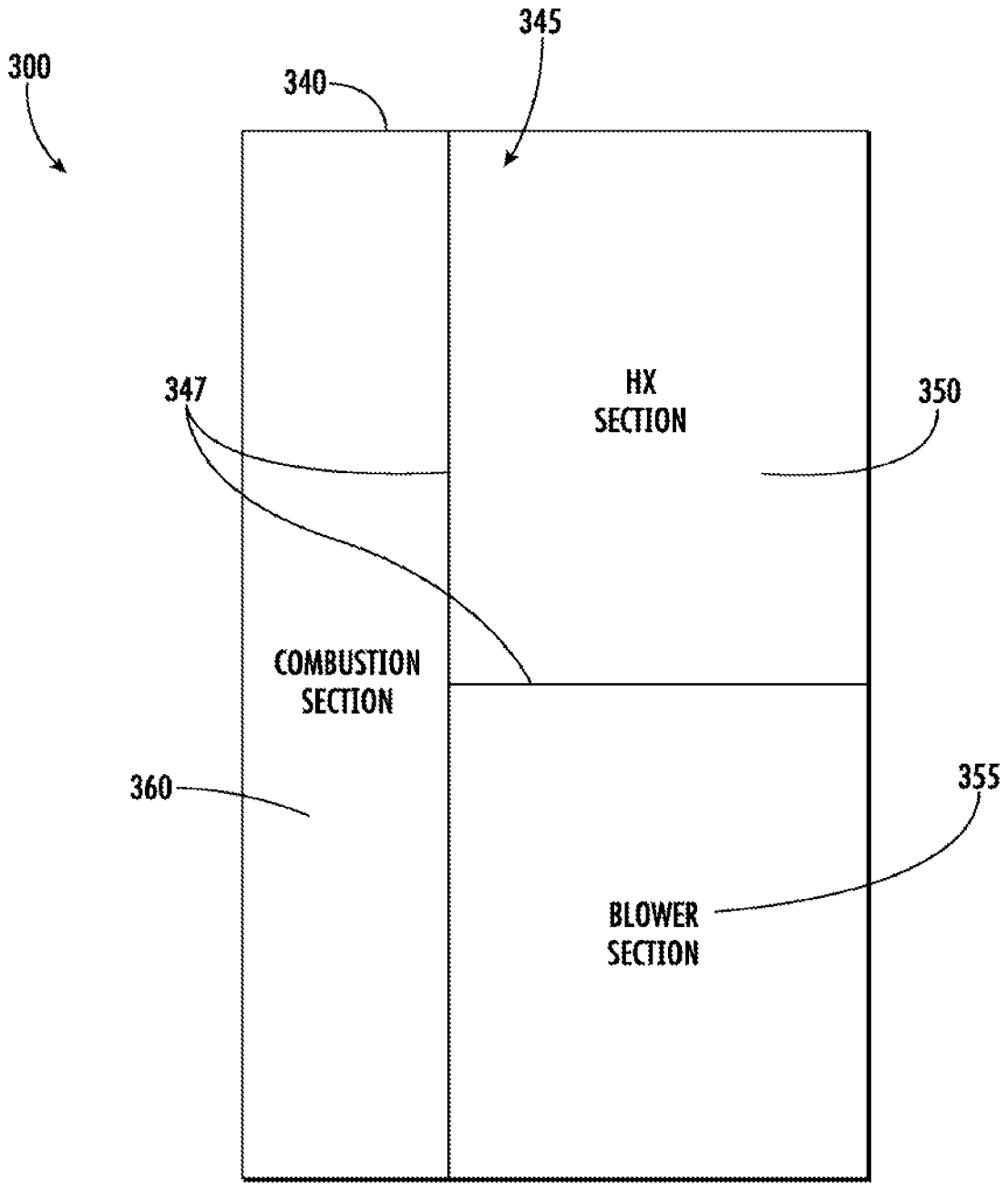
FIG. 3 is a schematic diagram of a gas-fired furnace, according to an example embodiment of the present disclosure.
Figure 4A:
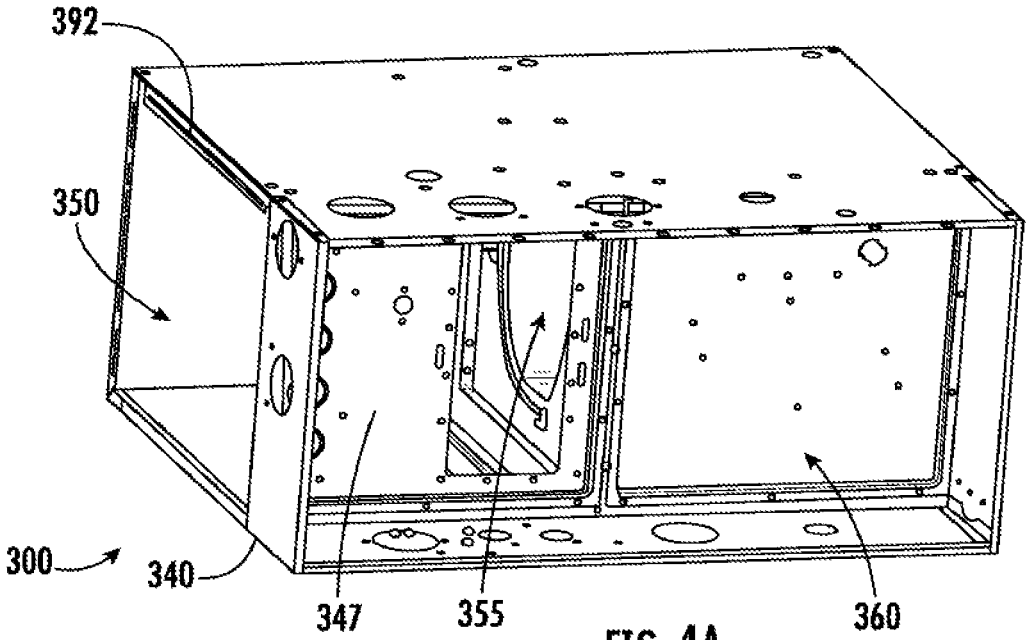
FIG. 4A is an illustration of an enclosure for a gas-fired furnace, according to an example embodiment of the present disclosure.
Figure 4B:
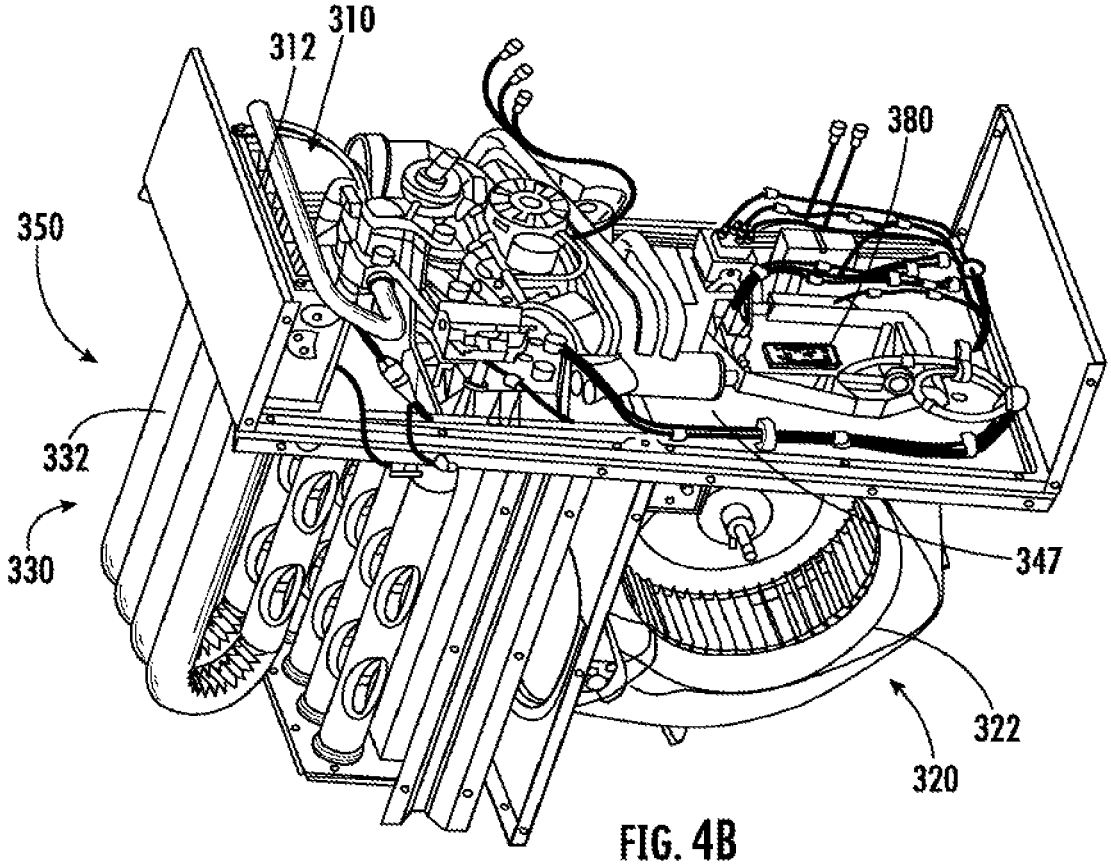
FIG. 4B is an illustration of example of components for a gas-fired furnace, according to an example embodiment of the present disclosure.

Referring now to FIGS. 3, 4A, and 4B an embodiment of a gas-fired furnace 300 is shown. In some embodiments, the furnace 300 may comprise components of an HVAC system that includes an indoor unit comprising a furnace. The furnace 300 may be configured as an indoor furnace that provides conditioned fluid, often air, to a comfort zone of an indoor space. However, in general, the components of the furnace 300 may be equally employed in an outdoor or weatherized furnace to condition an interior space. Moreover, the furnace 300 may be used in residential or commercial applications.

The furnace of FIGS. 3, 4A, and 4B is an example of a furnace that can utilize the disclosed system and method. In the depicted embodiments, the furnace 300 includes a burner system 310, a blower system 320, and a heat exchanger system 330. The furnace 300 also includes an enclosure 340, which may partition a furnace into one or more compartments to house various components (e.g., the burner system 310, the blower system 320, and the heat exchanger system 330, among other compartments and components) of the furnace 300.

FIG. 3 shows an illustration of an example enclosure 340 that may be implemented with the furnace 300 in some embodiments. The enclosure 340 has an interior space 345 that may be partitioned into a plurality of compartments: a heat exchanger compartment 350, a blower compartment 355, and a combustion compartment 360. FIG. 3 further shows illustrations of how the compartments may be configured within the furnace 300.

FIG. 4A shows an example illustration of an enclosure 340 that may be implemented with some embodiments, such as the embodiment of the furnace 300 shown in FIG. 3. This enclosure may include a partition 347 that divides the furnace 300 into a plurality of compartments, such as the compartments shown in FIGS. 3 and 4A. The partition 347 may comprise a single component or it may be made up of a plurality of components. The partition 347 may separate the interior space 345 within furnace 300 into multiple compartments.

FIG. 4B shows an example illustration of various furnace components that, in some embodiments, may be included within the furnace 300 as well as the various furnace compartments. These components include a burner 312, a circulation blower 322, and a heat exchanger 332.

For the furnace shown in the embodiment of FIGS. 3 and 4, conditioned return air 397 (e.g., FIG. 7) is received in the blower compartment 355, passes to the heat exchanger compartment 350 and exits the heat exchange compartment through conditioned air outlet 392 as conditioned supply air 375 (e.g., FIG. 7). The blower compartment 355 may be configured to receive the conditioned return air 397 through one or more return air inlets 399 formed at various locations through the cabinet 340. The conditioned air outlet 392 may be fixed relative to the cabinet 340 and the compartments therein. The orientation of the furnace may therefore be defined by the direction that the conditioned air outlet faces when the furnace is in its installed, operating position when the furnace is viewed from the front. For clarity, FIG. 4A shows a front, left, top perspective.

Figure 5:
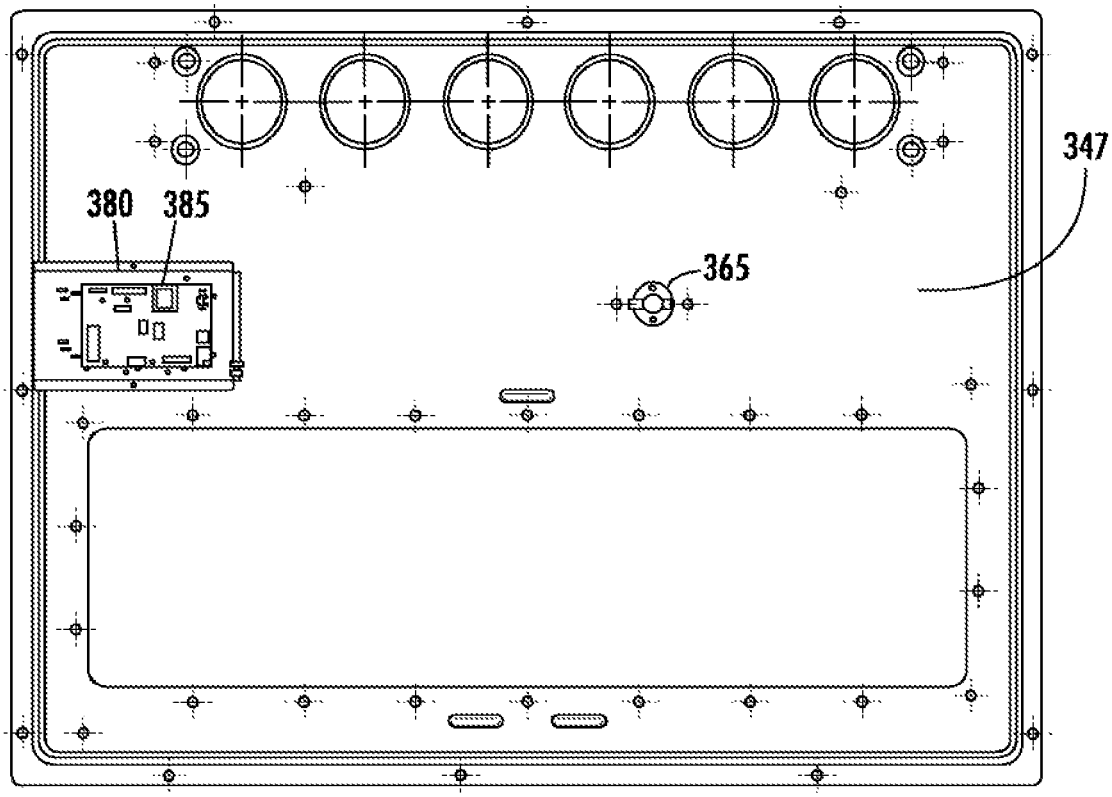
FIG. 5 is an illustration of a portion of a furnace vestibule, according to an example embodiment of the present disclosure.

FIG. 5 shows an illustration of a partition 347 that may be used in accordance with some embodiments of the present disclosure. The partition 347 may be a single component or may comprise a plurality of components. In particular, FIG. 5 shows an embodiment where partition 347 separates the combustion compartment 360 from the heat exchanger compartment (not shown) and the blower compartment (not shown). The partition 347 may also provide structural support for various combustion components.

FIG. 5 further shows an embodiment that includes a temperature sensor 365 located on the partition 347. The temperature sensor 365 may be located at any of a number of different locations on the partition 347. At each location, the temperature sensor 365 measures the temperature, providing an indication of the temperature of the various furnace components. In some embodiments, the temperature sensor 365 is designed to provide an indication of the conditioned supply air temperature and is located on the partition 347 accordingly. Some embodiments may include two or more temperature sensors. These temperature sensors may be located at different locations on the partition 347, on other furnace components, outside furnace, or combinations thereof.

The embodiment depicted in FIG. 5 also includes an integrated furnace control board 380 located on the partition 347. In the depicted embodiment, an orientation sensor 385 is located on the integrated furnace control board 380. The orientation sensor 385 provides the measured orientation, which provides an indication of the operating orientation of the furnace 300, and potentially an indication of the orientation of the supply air duct (e.g., upwards, downwards, horizontal right or left) when the furnace 300 is in operation.

The disclosure further contemplates additional locations for the orientation sensor. For example, an orientation sensor may be located outside the integrated furnace control board. An orientation sensor may also be located anywhere inside the furnace or outside furnace provided it provides an indication of the appropriate measured orientation information.

Figure 6A:
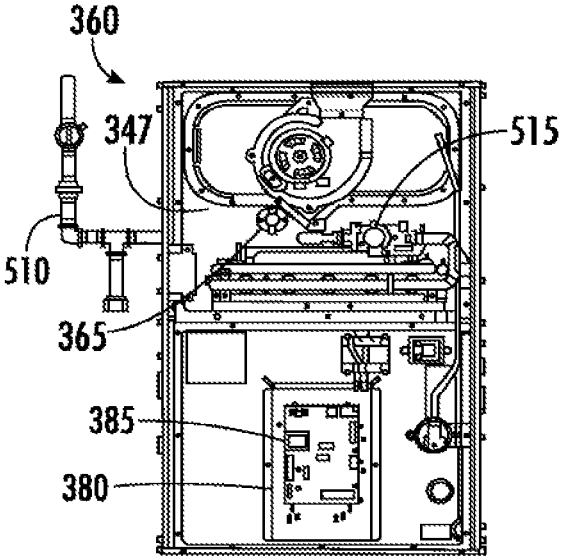
FIG. 6A is a front view illustration of the combustion section of a gas-fired furnace in an upward flow configuration, according to an example embodiment of the present disclosure.
Figure 6B:
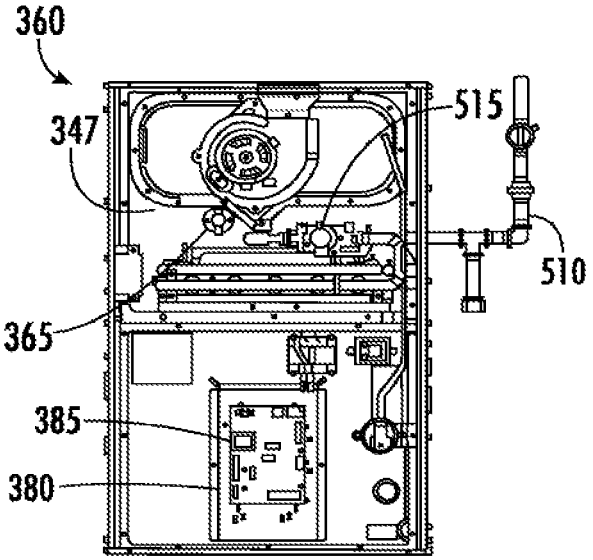
FIG. 6B is a front view illustration of the combustion section of a gas-fired furnace in an upward flow configuration, according to an example embodiment of the present disclosure.

FIGS. 6A and 6B show illustrations of a front view of a combustion compartment 360 oriented in an upflow configuration according to an example embodiment of the present disclosure. In the illustrated embodiment, conditioned supply air will exit the "top" of the furnace in the illustrated orientation. The depicted embodiments show a temperature sensor 365 located in the combustion compartment 360 and coupled to the partition 347. The depicted embodiments also include the furnace control board 380 with an orientation sensor 385 located within the combustion compartment 350. The principle difference between the embodiments shown in FIGS. 6A and 6B is that the embodiment of FIG. 6A has a left side gas supply line 510, and the embodiment of FIG. 6B has a right side gas supply line 510. Both depicted embodiments show a gas valve 515.

Figure 7A:
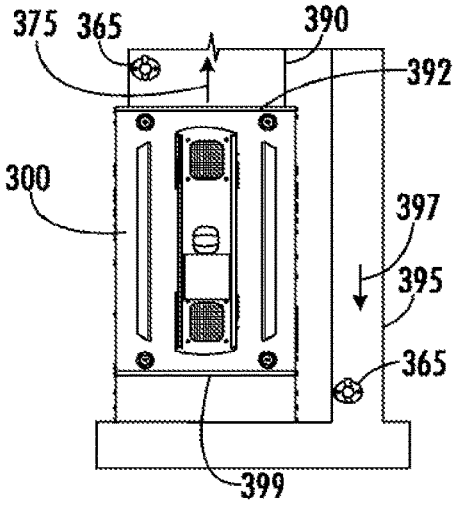
FIG. 7A is a front view illustration of a furnace in an upward flow configuration with ducted supply and return, according to an example embodiment of the present disclosure.
Figure 7B:
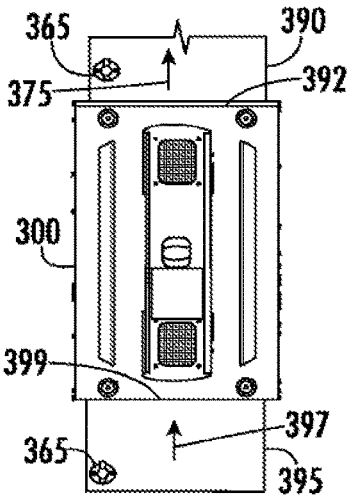
FIG. 7B is a front view illustration of a furnace in an upward flow configuration with ducted supply and return, according to an example embodiment of the present disclosure.
Figure 7C:
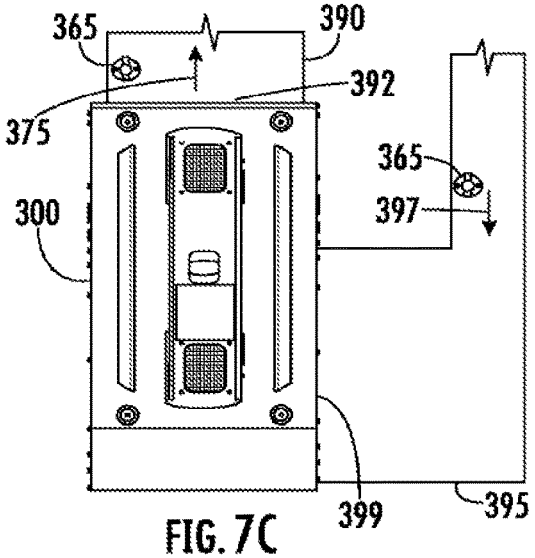
FIG. 7C is a front view illustration of a furnace in an upward flow configuration with ducted supply and return, according to an example embodiment of the present disclosure.
Figure 7D:
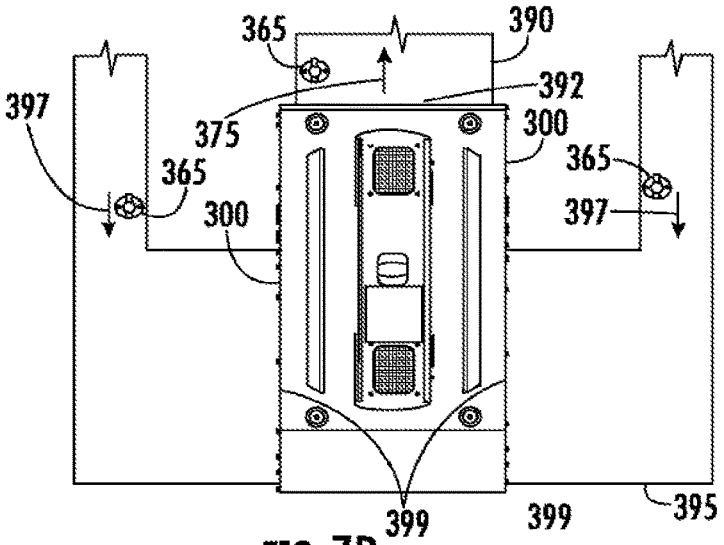
FIG. 7D is a front view illustration of a furnace in an upward flow configuration with ducted supply and return, according to an example embodiment of the present disclosure.

FIGS. 7A-D also show illustrations of additional embodiments of a furnace utilizing the disclosed system in an upflow configuration. The depicted embodiments show a ducted air supply 390 directing conditioned supply air 375 from a conditioned air outlet 392 of the furnace 300, and a return air duct 395 directing conditioned return air 397 to a conditioned air inlet 399 of the furnace 300. The conditioned air inlet 399 may be positioned through the bottom or the sides of the cabinet. A temperature sensor 365 is located on each duct. FIG. 7D shows two parallel return ducts 395 each with a temperature sensor 365. The depicted embodiments may further contain one or more additional temperature sensors located within the furnace 300. In some of the embodiments, each of the temperature sensors 365 measures the temperature of the furnace 300 independently. In some embodiments, the measured temperature from the supply duct 390 and the measured temperature of the return duct 395 are used to provide a differential temperature indicating the temperature rise in the conditioned air across the furnace 300. In some embodiments, such as the one shown in FIG. 7D, the system may take the average temperature measurements from the temperature sensors 365 at the return air ducts 395 to determine the return air temperature. The average return air temperature may be used with the measured temperature from the temperature sensor 365 at the supply air duct 390 to determine the differential temperature. In some embodiments, the system uses the average of all temperature measurements to determine the operation of the furnace 300. In some embodiments, the system does not use all of the temperature measurements taken to determine the operation of the furnace 300.

Figure 8A:
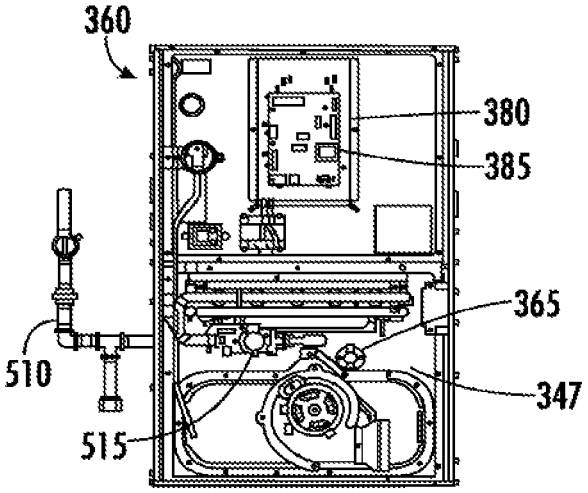
FIG. 8A is a front view illustration of the combustion section of a gas-fired furnace in a downward flow configuration, according to an example embodiment of the present disclosure.
Figure 8B:
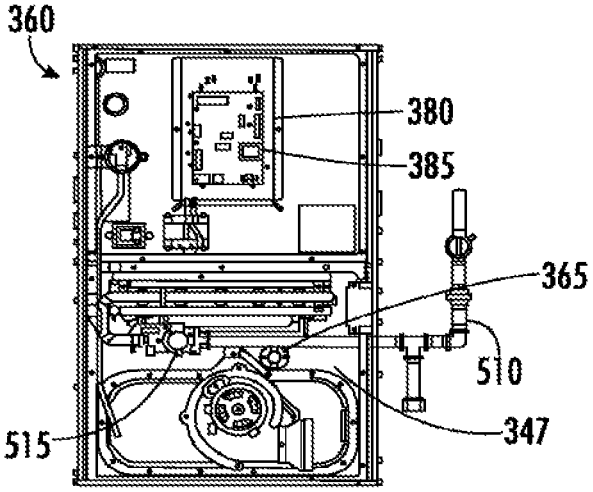
FIG. 8B is a front view illustration of the combustion section of a gas-fired furnace in a downward flow configuration, according to an example embodiment of the present disclosure.
Figure 9A:
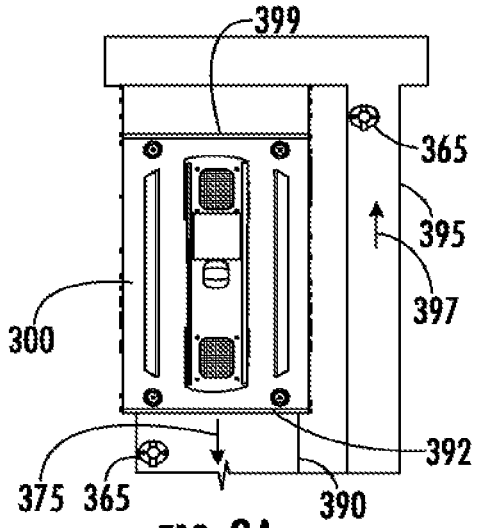
FIG. 9A is a front view illustration of a furnace in a downward flow configuration with ducted supply and return, according to an example embodiment of the present disclosure.
Figure 9B:
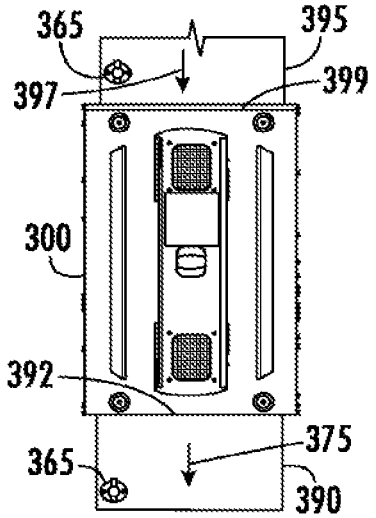
FIG. 9B is a front view illustration of a furnace in a downward flow configuration with ducted supply and return, according to an example embodiment of the present disclosure.
Figure 9C:
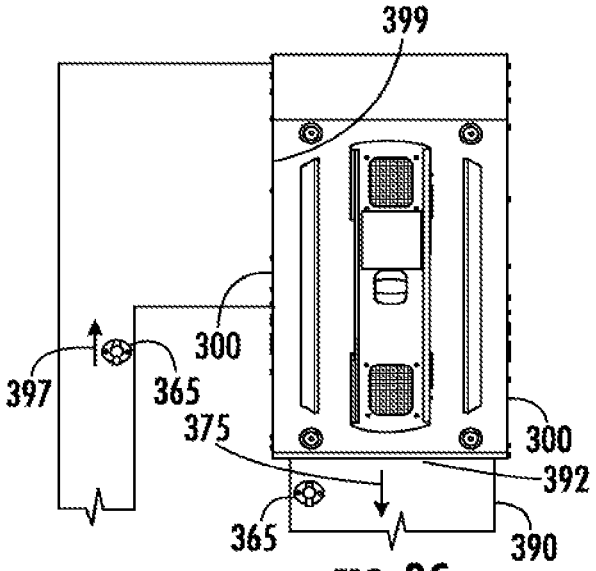
FIG. 9C is a front view illustration of a furnace in a downward flow configuration with ducted supply and return, according to an example embodiment of the present disclosure.

FIGS. 8A-13C show embodiments of the present system that are similar to those shown in FIGS. 6 and 7, however FIGS. 8A-13C show different configurations. FIGS. 8 and 9 show the present disclosure in a downflow configuration. In particular, FIGS. 8A and 8B show a front view of the combustion compartment 360 when the furnace is in a downflow configuration and conditioned supply air exits downwardly from the furance from the illustrated perspective. FIGS. 9A-C show embodiments of a furnace 300 with the supply air duct 390 and return air duct 395 similar to the embodiments shown in FIGS. 7A-C, but in downflow configurations instead of upflow configurations.

Figure 10A:
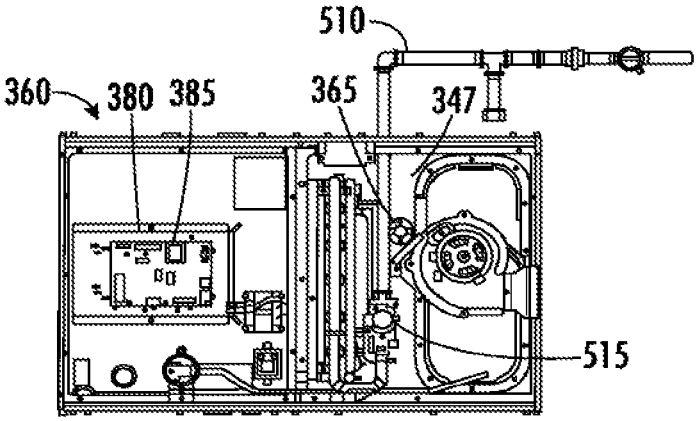
FIG. 10A is a front view illustration of the combustion section of a gas-fired furnace in a rightward flow configuration, according to an example embodiment of the present disclosure.
Figure 10B:
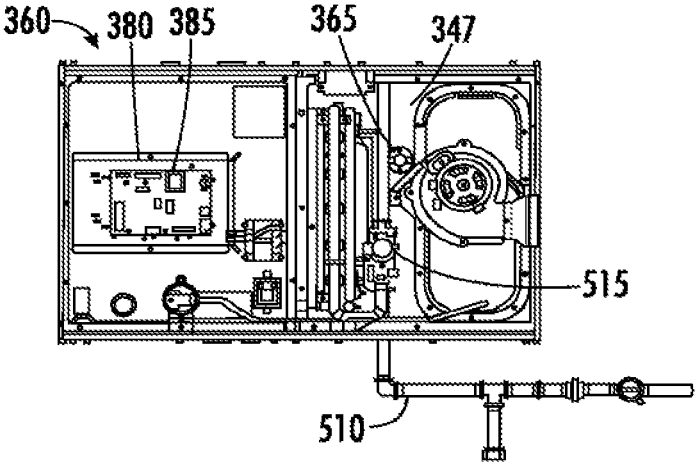
FIG. 10B is a front view illustration of the combustion section of a gas-fired furnace in a rightward flow configuration, according to an example embodiment of the present disclosure.
Figure 11A:
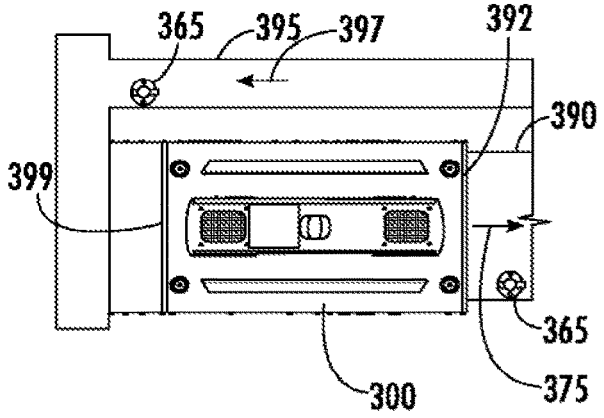
FIG. 11A is a front view illustration of a furnace in a rightward flow configuration with ducted supply and return, according to an example embodiment of the present disclosure.
Figure 11B:
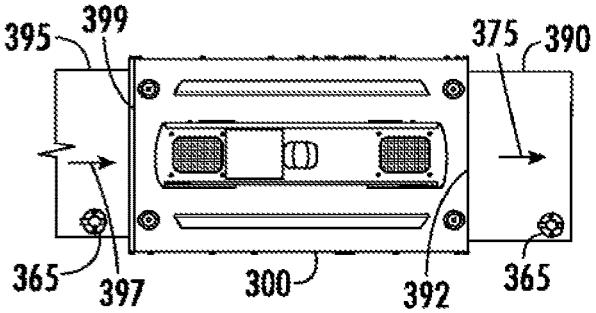
FIG. 11B is a front view illustration of a furnace in a rightward flow configuration with ducted supply and return, according to an example embodiment of the present disclosure.
Figure 11C:
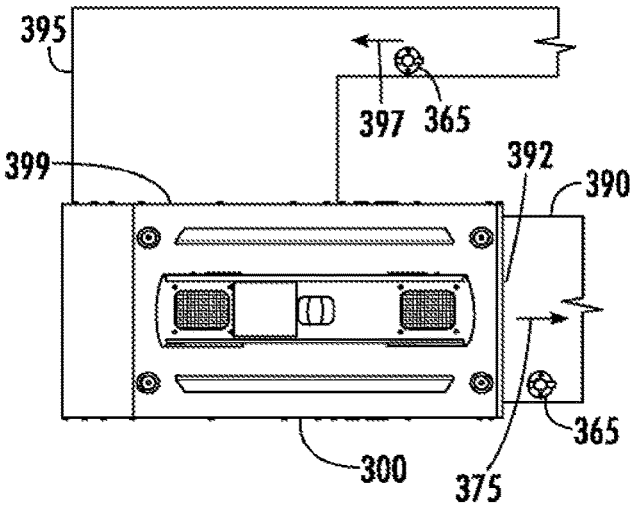
FIG. 11C is a front view illustration of a furnace in a rightward flow configuration with ducted supply and return, according to an example embodiment of the present disclosure.

FIGS. 10A-11C show a right-flow configuration where a furnace 300 is orientated in a horizontal orientation. In particular, FIGS. 10A and 10B show a front view of the combustion compartment 350 with a right-flow configuration. The depicted embodiments in FIGS. 10A and 10B are similar to the embodiments shown in FIGS. 6A and 6B, but the embodiments in 10A and 10B have a different orientation. Similarly, FIGS. 11A-C show embodiments of a furnace 300 with the supply air duct 390 and return air duct 395 in a right-flow configuration, again containing similar components and structure to the embodiments shown in FIGS. 7A-C but with a different orientation.

Figure 12A:
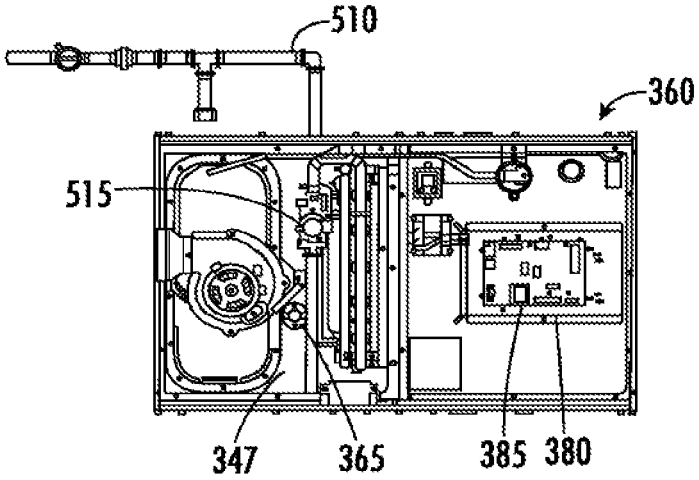
FIG. 12A is a front view illustration of the combustion section of a gas-fired furnace in a leftward flow configuration, according to an example embodiment of the present disclosure.
Figure 12B:
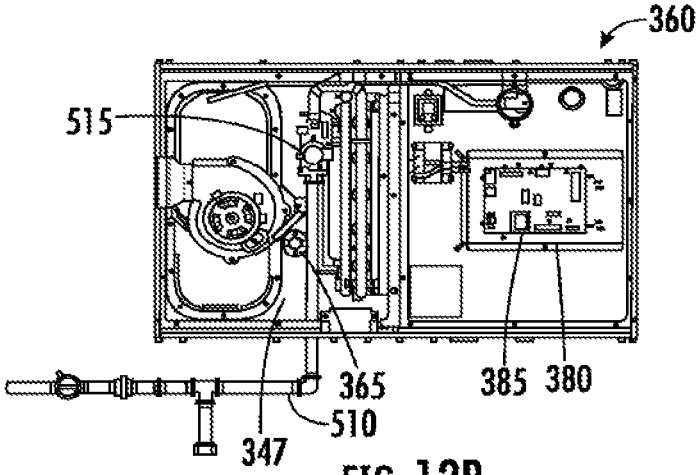
FIG. 12B is a front view illustration of the combustion section of a gas-fired furnace in a leftward flow configuration, according to an example embodiment of the present disclosure.
Figure 13A:
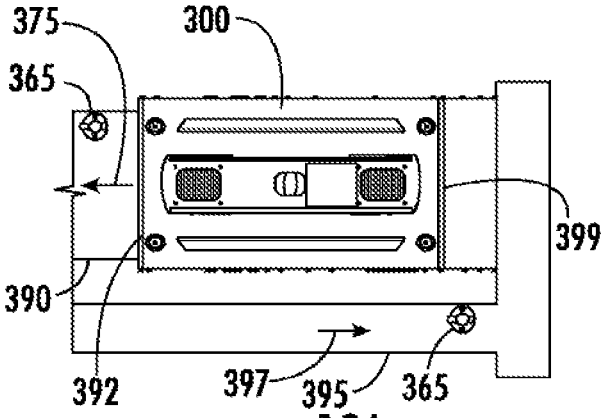
FIG. 13A is a front view illustration of a furnace in a leftward flow configuration with ducted supply and return, according to an example embodiment of the present disclosure.
Figure 13B:
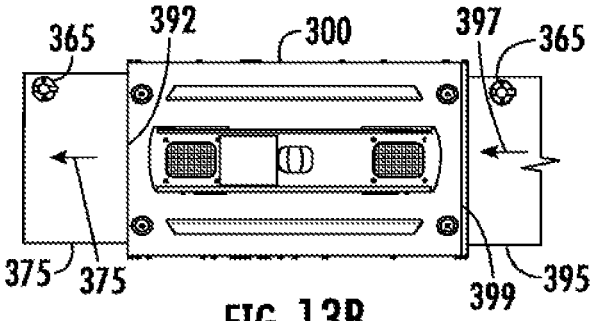
FIG. 13B is a front view illustration of a furnace in a leftward flow configuration with ducted supply and return, according to an example embodiment of the present disclosure.
Figure 13C:
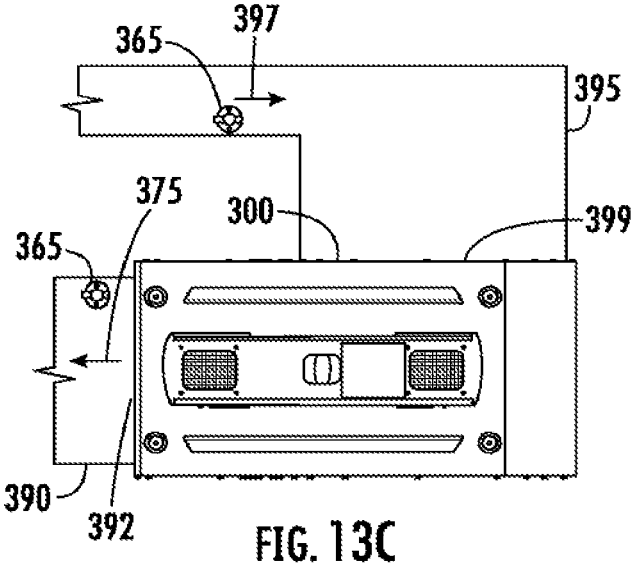
FIG. 13C is a front view illustration of a furnace in a leftward flow configuration with ducted supply and return, according to an example embodiment of the present disclosure.

FIGS. 12A-13C show a left-flow configuration where a furnace 300 is orientated in a horizontal orientation. In particular, FIGS. 12A and 12B show a front view of the combustion compartment 350 with a left-flow configuration. The depicted embodiments in FIGS. 12A and 12B are similar to the embodiments shown in FIGS. 6A and 6B, but the embodiments in 12A and 12B have a different orientation. Similarly, FIGS. 13A-C show embodiments of a furnace 300 with the supply air duct 390 and return air duct 395 in a right-flow configuration, again containing similar components and structure to the embodiments shown in FIGS. 7A-C, but with a different orientation.

Many modifications and other implementations of the disclosure set forth herein will come to mind to one skilled in the art to which the disclosure pertains having the benefit of the teachings presented in the foregoing description and the associated figures. Therefore, it is to be understood that the disclosure is not to be limited to the specific implementations disclosed and that modifications and other implementations are intended to be included within the scope of the appended claims. Moreover, although the foregoing description and the associated figures describe example implementations in the context of certain example combinations of elements and/or functions, it should be appreciated that different combinations of elements and/or functions may be provided by alternative implementations without departing from the scope of the appended claims. In this regard, for example, different combinations of elements and/or functions than those explicitly described above are also contemplated as may be set forth in some of the appended claims. Although specific terms are employed herein, they are used in a generic and descriptive sense only and not for purposes of limitation.

What is claimed is:

1. A control system for an HVAC device comprising:

a memory configured to store computer-readable program code including a control-related software application; and control circuitry configured to access the memory, and execute the computer-readable program code to cause the control circuitry to at least:

determine an operating orientation of the HVAC device using an orientation sensor, determine an operating control setting associated with the HVAC device, wherein the operating control setting is dependent, at least in part, on the operating orientation of the HVAC device, monitor a parameter associated with the HVAC device during operation using a sensor, determine a sensor input related to the parameter associated with the HVAC device, and operate the HVAC device based, at least in part, on a comparison between the sensor input and the determined operating control setting.

2. The control system of claim 1, wherein the orientation sensor is one of a gyroscope or an accelerometer.

3. The control system of claim 1, wherein the operating control setting is a thermal operating control set point, wherein the parameter is a temperature associated with the HVAC device, and wherein the sensor input is a temperature sensor input related to the temperature of the HVAC device.

4. The control system of claim 3, wherein the temperature associated with the HVAC device is a supply air temperature.

5. The control system of claim 3, wherein the temperature associated with the HVAC device is a temperature rise of a conditioned air fluid flowing through the HVAC device.

6. The control system of claim 1, wherein the control circuitry configured to access the memory, and execute the computer-readable program code to cause the control circuitry to operate the device is further configured to shut off the operation of the HVAC device when the sensor input exceeds the operating control setting.

7. The control system of claim 1, wherein the control circuitry configured to access the memory, and execute the computer-readable program code to cause the control circuitry to operate the HVAC device is further configured to lower the capacity of the device output when the sensor input exceeds the operating control set point.

8. A control system for an HVAC device comprising:

a memory configured to store computer-readable program code including a control-related software application; and a remote device including control circuitry, the control circuitry configured to access the memory, and execute the computer-readable program code to cause the control circuitry to at least:

determine an operating orientation of the HVAC device using an orientation sensor, determine an operating control setting associated with the HVAC device, wherein the operating control setting is dependent, at least in part, on the operating orientation of the HVAC device, and set the HVAC device to operate based on, at least in part, on the selected operating control setting.

9. The control system of claim 8, wherein the control circuitry is further configured to access the memory, and execute the computer-readable program code to cause to the control circuitry to receive signals from the orientation sensor via a wireless signal.

10. The control system of claim 8, wherein the HVAC device is a furnace and includes a furnace control board, wherein the operating control setting is a thermal operating control set point, and wherein the furnace control board is coupled to the orientation sensor and a temperature sensor, the temperature sensor configured to provide a signal indicative of a temperature associated with the furnace, and the furnace control board is further wirelessly coupled to the control circuitry and configured to:

transmit signals from the orientation sensor to the remote device;

receive the selected operating control set point from remote device;

receive the signal from the temperature sensor;

determine a temperature sensor input based on the signal from the temperature sensor; and operate the HVAC device based, at least in part, on the comparison between the temperature sensor input and the thermal operating control set point.

11. The control system of claim 10, wherein the temperature sensor is one of a thermistor or a thermocouple.

12. The control system of claim 10, wherein the temperature associated with the HVAC device is a supply air temperature.

13. The control system of claim 10, wherein the temperature associated with the HVAC device is a temperature rise of a conditioned air fluid flowing through the HVAC device.

14. The control system of claim 10, wherein the furnace control board configured to operate the HVAC device is further configured to shut off the operation of the HVAC device when the temperature sensor input exceeds the operating thermal control set point.

15. The control system of claim 10, wherein the furnace control board configured to operate the HVAC device is further configured to lower the capacity of the device output when the temperature sensor input exceeds the operating thermal control set point.

16. A method of controlling an HVAC device comprising:

determining an operating orientation of the HVAC device using an orientation sensor;

determining an operating control setting associated with the HVAC device, wherein the operating control setting is dependent at least in part on the operating orientation of the HVAC device;

monitoring a parameter associated with the HVAC device during operation;

determining a sensor input related to the parameter associated with the HVAC device; and operating the HVAC device based, at least in part, on a comparison between the sensor input and the determined operating control setting.

17. The method of claim 16, wherein the operating control setting is a thermal operating control set point, wherein the parameter is a temperature associated with the HVAC device, and wherein the sensor input is a temperature sensor input related to the temperature of the HVAC device.

18. The method of claim 17, wherein the temperature associated with the HVAC device is a supply air temperature.

19. The method of claim 17, wherein the temperature associated with the HVAC device is a temperature rise conditioned air fluid flowing through the HVAC device.

20. The method of claim 16, wherein operating the HVAC device further includes shutting off the operation of the HVAC device when the sensor input exceeds the operating control set point.

* * * * *